United States Patent [19]

Molitorisz

[11] 4,163,419

[45] Aug. 7, 1979

[54] ROTARY COMPACTING MACHINE FOR FIBROUS MATERIAL

[76] Inventor: Joseph Molitorisz, 624 81st Ave. NE., Bellevue, Wash. 98004

[21] Appl. No.: 919,922

[22] Filed: Jul. 17, 1978

[51] Int. Cl.[2] ..... B30B 3/04

[52] U.S. Cl. ..... 100/89; 308/72

[58] Field of Search ..... 100/86, 89; 56/1, 341; 308/72

[56] References Cited

U.S. PATENT DOCUMENTS

| | | | |
|---|---|---|---|
| 2,654,643 | 10/1953 | Reese | 308/72 |
| 3,386,373 | 6/1968 | Bushmeyer | 100/89 |
| 3,691,941 | 9/1972 | Molitorisz | 100/89 |
| 3,899,964 | 8/1975 | Molitorisz | 100/89 |
| 4,014,596 | 3/1977 | Kazama | 308/72 |

*Primary Examiner*—Peter Feldman

[57] ABSTRACT

A rolling-compressing apparatus for forming loose fibrous material into continuous dense cylindrical core which is cut into individual rolls of desired length. The core forming channel is confined by a plurality of circumferentially arranged compression rollers.

The improved suspension and drive mechanism of the compression rollers, subject to this invention allows the necessary angular movement of the compression rollers relative to the drive shafts of the main power drive train and utilizes effective means for the transfer of the driving torque.

1 Claim, 4 Drawing Figures

ROTARY COMPACTING MACHINE FOR FIBROUS MATERIAL

BACKGROUND OF THE INVENTION

1. Field of the Invention

This invention pertains to apparatus for forming dense continuous cylindrical core of fibrous material in a core forming channel of rotary compacting machines, which are based on the rolling-compressing technique. The inventions described hereunder cover certain improvements in the compression roller mechanism resulting in better overall performance and in reduced manufacturing costs of the machines.

2. Description of the Prior Art

Rolling-compressing core forming apparatus of frusto-conical and hyperboloid compression roller configurations have been developed using self-adjusting compression roller systems to induce simultaneous rotational and axial displacement of the formed core.

To improve the ability of such machines to absorb substantial fluctuations in the rate of intake of the loose fibrous material, flexible suspension of one or more of the compression rollers was applied. The flexible support and continuous power drive of the individual compression rollers was attempted by using power transmission joints which could provide radial and axial support together with the transmission of the driving torque to the roller.

Practical field experience with prior art rolling-compressing machines indicated the need for further improvements.

SUMMARY OF THE INVENTION

This invention is directed toward unique features employed to produce practical and commercially feasible mobile or stationary compacting machines using the rolling-compressing technique. While the various features work in combination they are also useful individually and provide improvements over similar features of prior art machines.

The first unique feature of my invention is the suspension and power drive of the individual compression rollers. While in prior art machines complicated components were applied which required frequent servicing and gave limited freedom for the angular motion of the compression roller, this new invention overcomes those difficiencies, using simple and highly reliable components. The radial and axial forces are distributed on relatively large lubricated surfaces considerably extending the life span of the components. The installation and servicing of the compression rollers is made very simle.

The second unique feature of my invention is the simple construction of the rather complicated peripheral configuration of the compression rollers. Prior art patents and publications presented detailed description of the frusto-conical or hyperboloid shape of the compression rollers. Such configurations were made by covering the substantially cylindrical roller body with elastic material and machining its surface to the desired shape, or by welding rigid steel bars to the substantially cylindrical roller body and machining the protruding bars to obtain the wanted effective peripheral configuration. In either case, costly manufacturing processes were encountered.

My invention presents simple and practical solutions to overcome those difficiencies.

U.S. Pat. No. 3,691,941 covers the use of protruding cleats made of flat steel bars welded to the cylindrical body of the compression roller and machined to the desired rotational configuration. In claim 1 of the above patent it is stated, quote: ". . . said protrusions having greater thikness at their ends than at the midsection of the roller to maintain a constant angular velocity ratio between the rollers and the core throughout the channel." End of quote.

In my invention the outside diameter of the body of the cylindrical roller and the thickness of the steel bars are selected to produce the desired minimum effective diameter of the compression roller when the bars are secured directly to the cylindrical roller body. The curvature for the quasi-hyperboloid configuration is obtained by securing the steel bars directly to the body of the cylindrical roller at its midsection and raising both ends of the bars by inserting properly dimensioned spacers between the roller body and the bars and securing them to the roller body. Additional securing may be applied along the bars.

My new invention not only eliminates the need of the costly machining, but also allows the use of steel bars with different crossectional profile, such as those with rounded edges. The intermittent securing of the bars to the roller body will allow some radial flexing of the bars which can repell the adhering hay praticles, thus keeping the surface of the compression roller relatively clean.

DESCRIPTION OF THE PREFERRED EMBODIMENT

Generally stated, the invention is practiced and applied in compacting machines for fibrous material using the rolling-compressing technique. The loose fibrous material is formed into continuous dense cylindrical core which is cut into desired length individual rolls.

Figure 1:
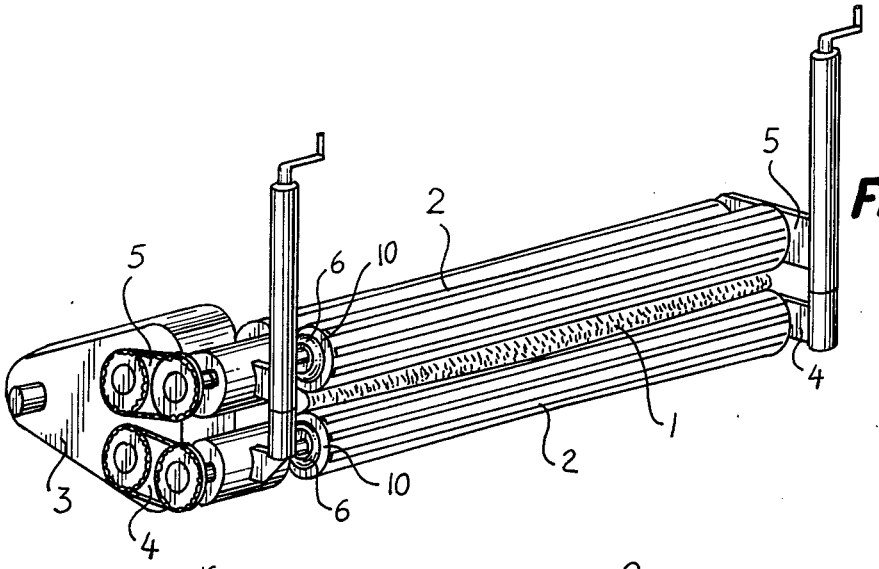
FIG. 1, is an isometric schematic view of the general arrangement of the compression roller system.

In the embodiment illustrated on FIG. 1, the means for compacting the fibrous material into a continuous cylindrical core (1) includes four compression rollers (2), the rollers are power driven by a suitable drive train (3), which is connected to a prime power source. The compression rollers are circumferentially spaced to confine the core forming channel. A space is provided between two adjacent rollers as a transverse inlet into the channel. The skewing of the compression roller system induces the rotational and axial motion for the core formed in the channel. Both the drive and the discharge ends of at least two of the compression rollers are supported by pairs of pivotally mounted and synchronously interconnected supporting arms, (4) and (5), which are spring biased inwardly allowing the radial movement of the compression rollers relative to the formed core.

Figure 2:
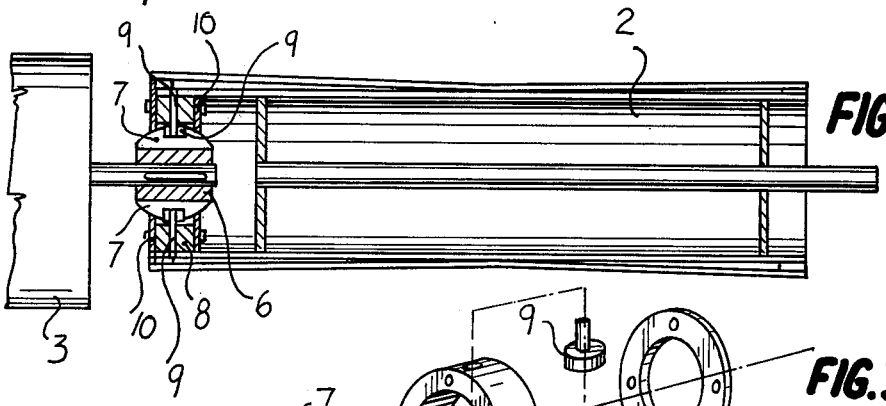
FIG. 2, is a vertical transverse section of a compression roller showing the suspension and power transmission components.
Figure 3:
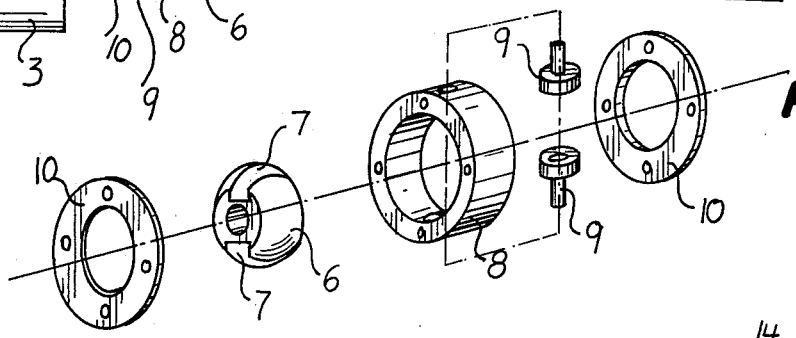
FIG. 3, is and exploded view of the suspension and power transmission components of the yoke mechanism.

FIG. 2, illustrates the support and power transmission components of the individual compression rollers. The sectioned spherical yoke (6) is keyed and mounted on one of the output drive shafts of the power transmission system. Two properly dimensioned and inwardly extending passage ways (7) are provided in radially opposing arrangements relative to the rotational axis of the yoke. FIG. 3 shows details of the yoke mechanism.

A properly dimensioned ring (8) is secured to the drive end of the compression roller. The inside diameter of the ring is made to slide over the spherical section of the yoke. Two properly dimensioned pins or pin supported rollers (9) are mounted on ring (8) extending inwardly toward the rotational axis of the ring. The pins or pin supported rollers are received by the corresponding passage ways of the spherical yoke assuring positive transfer for the driving torque from the output shaft of the main power transmission system (3) to the compression roller (2), regardless of the angular position of the compression roller relative to the yoke. On both sides of the ring (8) properly dimensioned retaining rings (10) are mounted to prevent the axial movement of the ring on the yoke. The smaller diameter circular opening of the retaining rings are beveled to provide greater contact surface with the spherical yoke.

Figure 4:
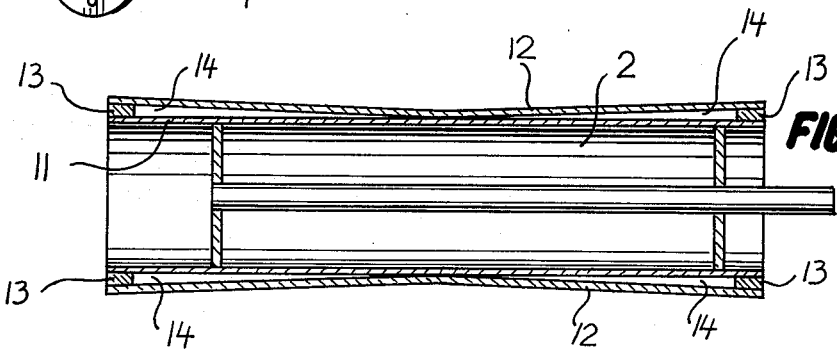
FIG. 4, is a vertical transverse section of the compression roller showing the general configuration of the attached ribs.

FIG. 4, illustrates the details of the construction of the compression roller. The diameter of the cylindrical body (11) of the compression roller is selected to produce the desired minimum effective diameter of the roller when a plurality of circumferentially arranged and properly spaced steel ribs (12) are attached directly to its surface. This minimum diameter is at or near the mid-section of the roller. After securing the bars at the mid-section, both of their ends are raised radially from the body of the roller and are held permanently in their raised position by inserting and securing properly dimensioned spacers (13) to both the bars and the roller body. The shape of the curvature of the raised steel bars is determined by several factors including; the length of the bars, the cross-sectional profile of the bars and the location of the securing means at the mid-section of the roller. By the proper selection of the above factors the actual curvature closely approximates the hyperboloid or the frusto-cone. Intermittent securing of the bars to the roller may be applied between the mid-section and the ends. The open space (14) between the bars and the roller body may be left free, or it may be filled with suitable elastic substance, such as rubber. To reduce the undesirable breaking or cutting effect of the sharp corners of flat steel bars on the fibrous material, different profile steel bars me be used. Through proper installation of the steel bars the costly machining to obtain the desired effective rotational profile of the compression rollers can be eliminated.

While the preferred forms of the invention have been illustrated and described, it should be understood that changes may be made without departing from the principles thereof. Accordingly, the invention is to be limited only by a literal interpretation of the claims appended hereto.

I claim:

1. A rolling-compressing apparatus for forming loose fibrous material into continuous dense cylindrical core which is cut into individual rolls of desired length, comprising; a core forming channel, said core forming channel being confined by and having a plurality of circumferentially arranged compression rollers, each of said compression rollers receiving power drive and simultaneous radial and axial support at its drive end from a yoke mechanism, said yoke mechanism consisting of; a substantially spherical sectioned yoke having two inwardly extending and radially opposite passage ways in the entire axial length of the yoke, said substantially spherical sectioned yoke being keyed and securely mounted on the output drive shaft of the power transmission system of the drive train of said rolling-compressing apparatus, said inwardly extending and radially opposite passage ways of said substantially spherical sectioned yoke receiving inwardly extended and radially opposite pins or pin supported rollers of a substantially cylindrical ring, the inside opening of said substantially cylindrical ring being slideably received over the substantially spherical section of said yoke, said pins or pin supported rollers being securely attached to said substantially cylindrical ring, said substantially cylindrical ring being restricted against axial movement relative to said substantially spherical sectioned yoke by properly dimensioned and securely attached retaining rings on both sides of said substantially cylindrical ring, the inside opening of said retaining rings being slideably received over the substantially spherical section of said yoke, said substantially cylindrical ring being securely attached to the drive end of said compression rollers of said rolling-compressing apparatus.

* * * * *